US008107866B2

(12) United States Patent
Kajita et al.

(10) Patent No.: US 8,107,866 B2
(45) Date of Patent: Jan. 31, 2012

(54) FIXING APPARATUS WITH PRESSURE MEMBER AND URGING MECHANISM AND RELATED IMAGE FORMING APPARATUS

(75) Inventors: Masahito Kajita, Nagoya (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 438 days.

(21) Appl. No.: 12/324,176

(22) Filed: Nov. 26, 2008

(65) Prior Publication Data

US 2009/0142113 A1 Jun. 4, 2009

(30) Foreign Application Priority Data

Nov. 30, 2007 (JP) ..... 2007-310805

(51) Int. Cl.
*G03G 15/20* (2006.01)

(52) U.S. Cl. ..... 399/328

(58) Field of Classification Search ..... 399/328, 399/320, 331; 219/216
See application file for complete search history.

(56) References Cited

U.S. PATENT DOCUMENTS

| | | | | |
|---|---|---|---|---|
| 5,331,385 | A * | 7/1994 | Ohtsuka et al. | 399/331 |
| 5,404,214 | A * | 4/1995 | Yoshimoto et al. | 399/329 |
| 2006/0210329 | A1 * | 9/2006 | Tsueda et al. | 399/328 |
| 2008/0118283 | A1 * | 5/2008 | Tsueda et al. | 399/333 |
| 2008/0219722 | A1 * | 9/2008 | Sone et al. | 399/328 |

FOREIGN PATENT DOCUMENTS

| | | |
|---|---|---|
| JP | 64-009484 | 1/1989 |
| JP | 05-257403 | 10/1993 |
| JP | 05257403 A * | 10/1993 |

* cited by examiner

*Primary Examiner* — Quana M Grainger
(74) *Attorney, Agent, or Firm* — Banner & Witcoff, Ltd.

(57) ABSTRACT

A fixing apparatus is described. This fixing apparatus may include a heating member, a pressure member opposed to the heating member, a first holding member holding the pressure member and an urging mechanism position-changeably supporting the pressure member through the first holding member and urging the pressure member toward the heating member through the first holding member. The first holding member is electrically connected with the urging mechanism. The first holding member and the urging mechanism are both formed of a conductive member, and the first holding member is grounded through the urging mechanism.

14 Claims, 10 Drawing Sheets

14

FIXING APPARATUS WITH PRESSURE MEMBER AND URGING MECHANISM AND RELATED IMAGE FORMING APPARATUS

CROSS REFERENCE TO RELATED APPLICATION

This application claims priority to Japanese Patent Application No. 2007-310805 filed on Nov. 30, 2007, the disclosure of which is hereby incorporated into the present application by reference.

TECHNICAL FIELD

The present invention relates to a fixing apparatus and an image forming apparatus such as a laser printer including the same.

BACKGROUND

An image forming apparatus such as a laser printer is provided with a fixing apparatus fixing toner transferred to a sheet to the sheet. The fixing apparatus includes a heating roller and a pressure roller arranged in a state pressed against the heating roller. The sheet to which the toner is transferred is transported between the heating roller and the pressure roller. While the sheet passes through the space between the heating roller and the pressure roller, the toner is fixed to the sheet by heating and pressing.

In relation to this type of fixing apparatus, it is known that the sheet is bent along the peripheral surface of the heating roller or the pressure roller, to result in the so-called curl. This curl causes a paper jam (defective transportation) or a disturbance in the state of sheets stacked on a sheet ejection tray.

In order to solve this problem, there is proposed a structure obtained by extending the pressure roller between a pair of support plates and connecting the support plates to a moving member thereby rendering the pressure roller position-changeable with respect to the heating roller along with the moving member. According to this structure, a curl, for example, can be corrected by changing the position of the pressure roller with respect to the heating roller in response to the state of the curl (state where the surface of the sheet to which the toner is transferred is concavely or convexly bent).

SUMMARY

In the fixing apparatus having the aforementioned structure, charges may be stored in the pressure roller, a member holding the pressure roller, the support plates around the same and the moving member following the use of the fixing apparatus. If the pressure roller or the like is left in the state storing charges, the stored charges are discharged to cause a noise in a signal for controlling each portion of the image forming apparatus or disturb the toner transferred to the sheet in an unfixed state. In this case, the quality of an image formed on the sheet is deteriorated.

The pressure roller, the member holding the pressure roller, the support plates and the moving member may be grounded, to be prevented from storing charges. However, it is difficult to ground these members, regardless of the positions of the pressure roller, the support plates and the moving member.

One aspect of the present invention may provide a fixing apparatus capable of reliably grounding a pressure member or a member holding the pressure member regardless of the position of the pressure member even if the pressure member is position-changeably provided and an image forming apparatus including the fixing apparatus.

The same or different aspect of the present invention may provide a fixing apparatus including: a heating member; a pressure member opposed to the heating member; a first holding member holding the pressure member; and an urging mechanism position-changeably supporting the pressure member through the first holding member and urging the pressure member toward the heating member through the first holding member, wherein the first holding member is electrically connected with the urging mechanism, the first holding member and the urging mechanism are both formed of a conductive member, and the first holding member is grounded through the urging mechanism.

The same or different aspect of the present invention may provide a fixing apparatus including: a heating member; a pressure member opposed to the heating member; and an urging mechanism position-changeably supporting the pressure member and urging the pressure member toward the heating member, wherein the pressure member is electrically connected with the urging mechanism, and the pressure member is grounded through the urging mechanism.

The same or different aspect of the present invention may provide a fixing apparatus including: a heating member; a pressure member opposed to the heating member; and a support mechanism position-changeably supporting the pressure member, wherein the pressure member is electrically connected with the support mechanism, the support mechanism is formed of a conductive member, and the pressure member is grounded through the support mechanism.

The same or different aspect of the present invention may provide a fixing apparatus including: a heating member; a pressure member opposed to the heating member; a first holding member holding the pressure member; and a support mechanism position-changeably supporting the pressure member through the first holding member, wherein the first holding member is electrically connected with the support mechanism, the support mechanism and the first holding member are formed of a conductive member, and the pressure member is grounded through the first holding member and the support mechanism.

The same or different aspect of the present invention may provide an image forming apparatus including: a fixing apparatus; a gear shaft made of a conductive material; and a driving gear rotatably supported on the gear shaft for transmitting driving force to the fixing apparatus, wherein the fixing apparatus includes: a heating member; a pressure member opposed to the heating member; a first holding member holding the pressure member; and an urging mechanism position-changeably supporting the pressure member through the first holding member and urging the pressure member toward the heating member through the first holding member, the first holding member is electrically connected with the urging mechanism, and the urging mechanism is grounded through the gear shaft.

DETAILED DESCRIPTION

Embodiments of the present invention are now described with reference to the accompanying drawings.

First Embodiment

1. Overall Structure of Laser Printer

Figure 1:
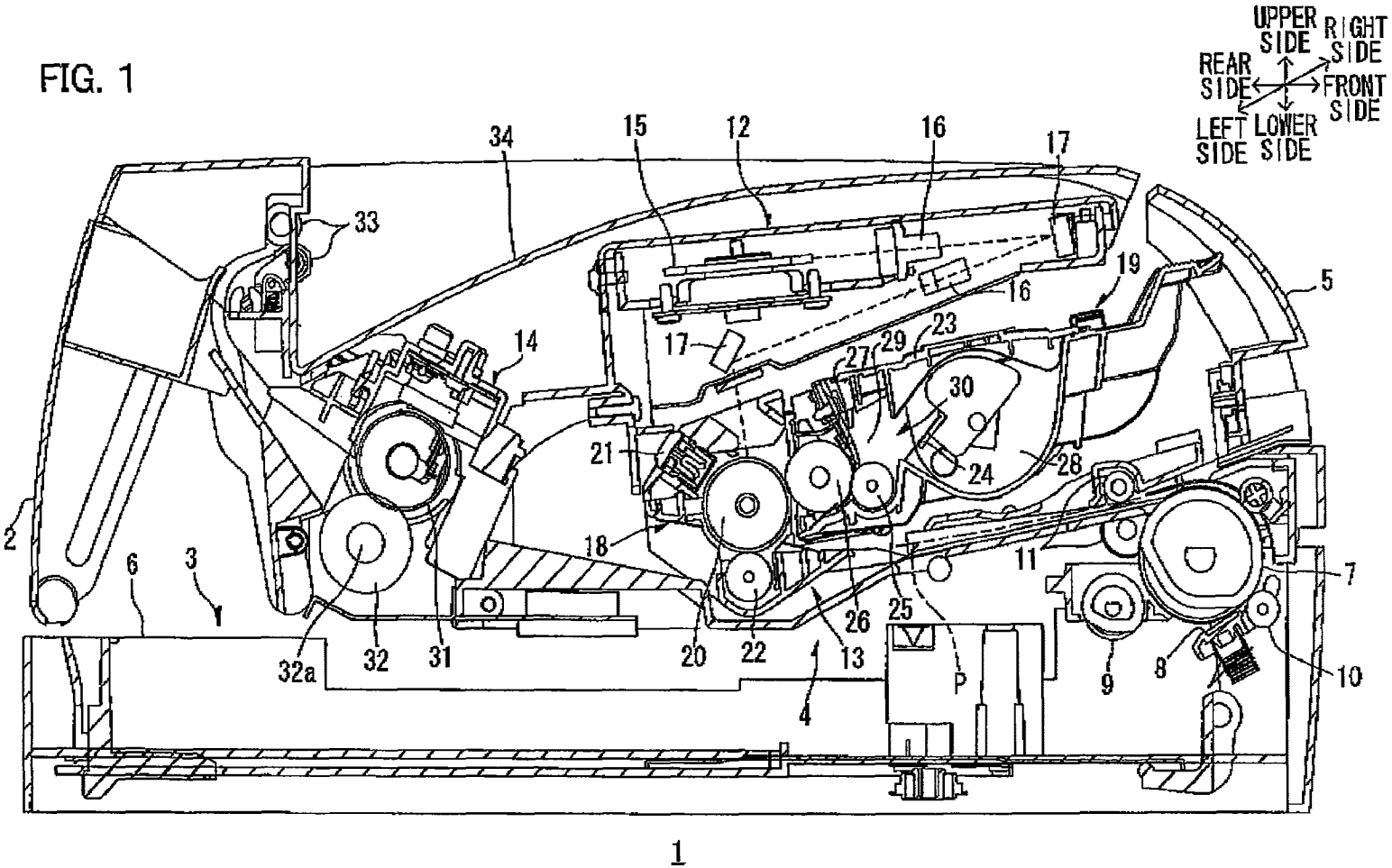
FIG. 1 is a side sectional view of a laser printer according to an embodiment of the present invention.

FIG. 1 is a side sectional view of a laser printer 1 according to a first embodiment of the present invention.

The laser printer 1 as an example of an image forming apparatus includes a feeder section 3 and an image forming section 4 in a main body casing 2.

A front cover 5 is provided on one sidewall of the main body casing 2 to be openable/closable about the lower end thereof. The front cover 5 is so opened as to open the internal space of the main body casing 2. In this state, a process cartridge 13 (described later) is detachably mountable to the internal space of the main casing 2. Then, the front cover 5 is so closed as to close the internal space of the main casing 2.

In the following description, it is assumed that the side (right side in FIG. 1) provided with the front cover 5 is the front side, and the opposite side (left side in FIG. 1) thereto is the rear side. The right and left sides are defined with reference to the laser printer 1 as viewed from the front side. Also as to the process cartridge 13 and a developing cartridge 19 (described later), the front, rear, right, left, upper and lower sides are defined with reference to the states mounted on the main body casing 2.

(1) Feeder Section

The feeder section 3 includes a sheet feeding tray 6, a sheet feeding roller 7, a sheet feeding pad 8, a pickup roller 9, a pinch roller 10 and a pair of resist rollers 11.

Sheets P as examples of a recording sheet are stacked in the sheet feeding tray 6. The pickup roller 9 feeds the sheet P located on the uppermost position in the sheet feeding tray 6 toward the space between the sheet feeding roller 7 and the sheet feeding pad 8. The fed sheet P successively passes through the space between the sheet feeding roller 7 and the sheet feeding pad 8 and the space between the sheet feeding roller 7 and the pinch roller 10, to be transported to the resist rollers 11. After resisting, the resist rollers 11 transport the sheet P to a transfer position (described later) of the image forming section 4.

(2) Image Forming Section

The image forming section 4 includes a scanner unit 12, the process cartridge 13 and a fixing unit 14 as an example of a fixing apparatus.

(2-1) Scanner Unit

The scanner unit 12 is arranged on an upper portion in the main body casing 2. The scanner unit 12 includes a laser (not shown), a polygonal mirror 15, a plurality of lenses 16 and a plurality of reflecting mirrors 17, and emits a laser beam to a photosensitive drum 20 (described later) of the process cartridge 13, as shown by the chain lines.

(2-2) Process Cartridge

The process cartridge 13 is arranged under the scanner unit 12. The process cartridge 13 includes a drum cartridge 18 and the developing cartridge 19 detachably mounted on the drum cartridge 18.

The photosensitive drum 20 is rotatably provided on the drum cartridge 18. In the drum cartridge 18, a scorotron charger 21 and a transfer roller 22 are arranged around the photosensitive drum 20.

The developing cartridge 19 includes an agitator 24, a feed roller 25, a developing roller 26 and a layer-thickness regulating blade 27 in a casing 23.

A toner accommodation chamber 28 and a developing chamber 29 are anteroposteriorly arranged in the casing 23. The toner accommodation chamber 28 and the developing chamber 29 communicate with each other through a communication port 30.

The toner accommodation chamber 28 accommodates nonmagnetic one-component positively charged polymer toner.

The agitator 24 is provided in the toner accommodation chamber 28.

The feed roller 25 is provided in the developing chamber 29 at the back of the communication port 30.

The developing roller 26 is provided in the developing chamber 29, in pressure contact with the feed roller 25 from the rear side.

The layer-thickness regulating blade 27 is in the form of a laterally extending plate. The layer-thickness regulating blade 27 has a base end portion fixed to the casing 23 and a free end portion in pressure contact with the peripheral surface of the developing roller 26.

(2-3) Developing/Transfer Operation

The toner accommodated in the toner accommodation chamber 28 is agitated by rotation of the agitator 24, to be partially fed to the feed roller 25 provided in the developing chamber 29 through the communication port 30. The toner fed to the feed roller 25 is fed to the developing roller 26 due to rotation of the feed roller 25. At this time, the toner is frictionally electrified to positive polarity between the feed roller 25 and the developing roller 26 to which a developing bias is applied. Thus, the thickness of the toner fed to the developing roller 26 is regulated by the layer-thickness regulating blade 27 following rotation of the developing roller 26, so that the toner is carried on the peripheral surface of the developing roller 26 as a thin layer of a constant thickness.

On the other hand, the surface of the photosensitive drum 20 is uniformly positively charged by the scorotron charger 21 following rotation of the photosensitive drum 20. The laser beam from the scanner unit 12 is selectively applied to the positively charged surface of the photosensitive drum 20, to form an electrostatic latent image based on image data.

When the electrostatic latent image formed on the surface of the photosensitive drum 20 is opposed to the developing roller 26 following the rotation of the photosensitive drum 20, the positively charged toner carried on the surface of the developing roller 26 is fed to the electrostatic latent image. Thus, the electrostatic latent image is visualized, and a toner image is carried on the surface of the photosensitive drum 20. Then, the toner image is transferred onto the sheet P transported to the space (transfer position) between the photosensitive drum 20 and the transfer roller 22.

(3) Fixing Unit

The fixing unit 14 is provided at the back of the process cartridge 13. The fixing unit 14 includes a heating roller 31 as an example of a heating member and a pressure roller 32 as an example of a pressure member brought into pressure contact with the heating roller 31 from below. The heating roller 31 includes a metal tube having a surface coated with fluororesin and a halogen lamp for heating inserted into the metal tube. The pressure roller 32 has a rotating shaft 32*a* of a metal covered with a rubber material.

The toner image transferred to the sheet P is heated and pressed while the sheet P passes through the space between the heating roller 31 and the pressure roller 32 in the fixing unit 14, to be fixed to the sheet P.

(4) Sheet Ejection

The sheet P to which the toner image is fixed is transported toward a sheet ejecting roller 33, and ejected onto a sheet ejection tray 34 formed on the upper surface of the main body casing 2 by the sheet ejecting roller 33.

2. Details of Fixing Unit

Figure 2:
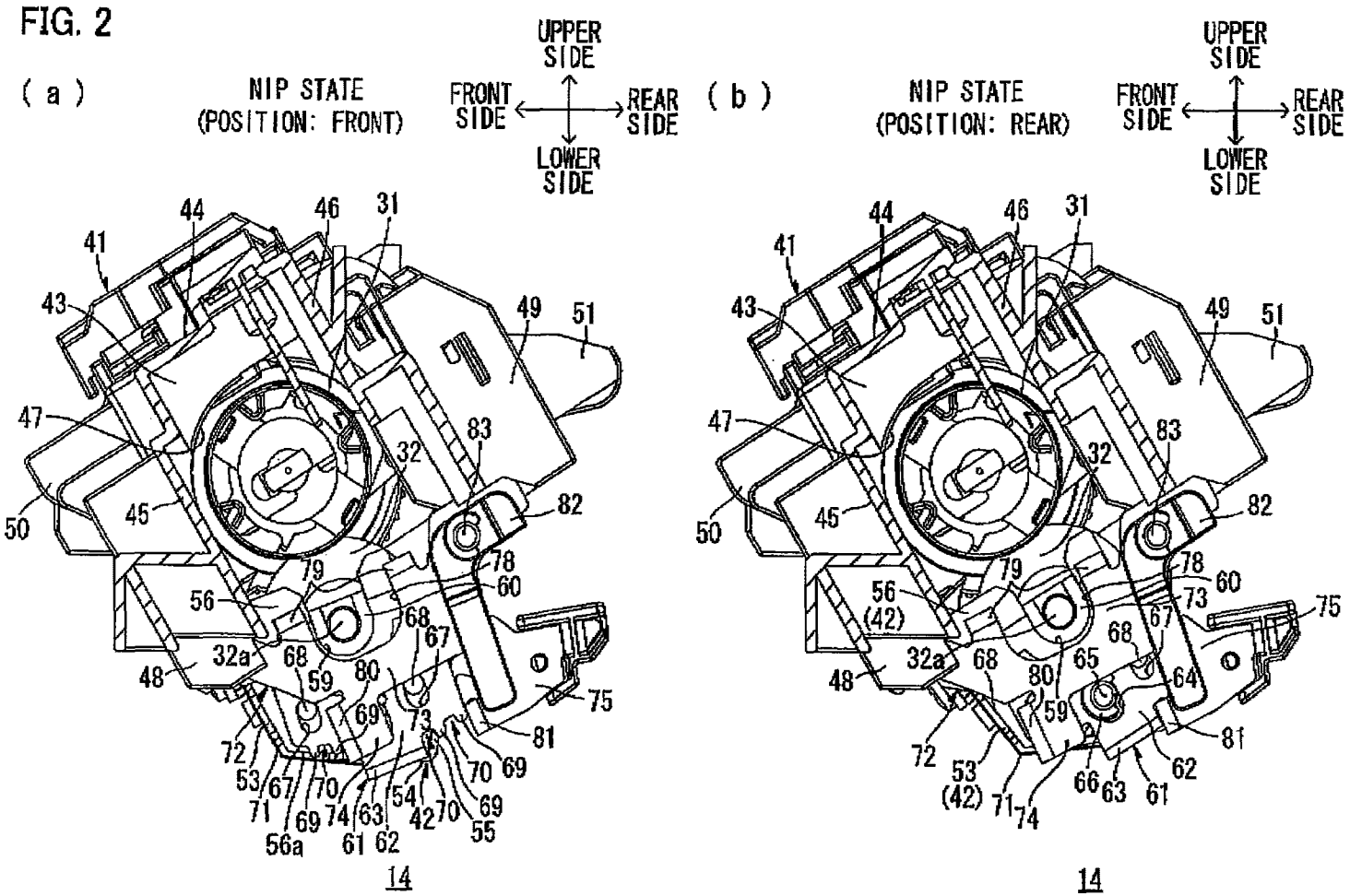
FIGS. 2(*a*) and 2(*b*) are partially cut right side elevational views showing a fixing unit in a nip state, with a pressure roller arranged relatively frontward and relatively rearward respectively.
Figure 5:
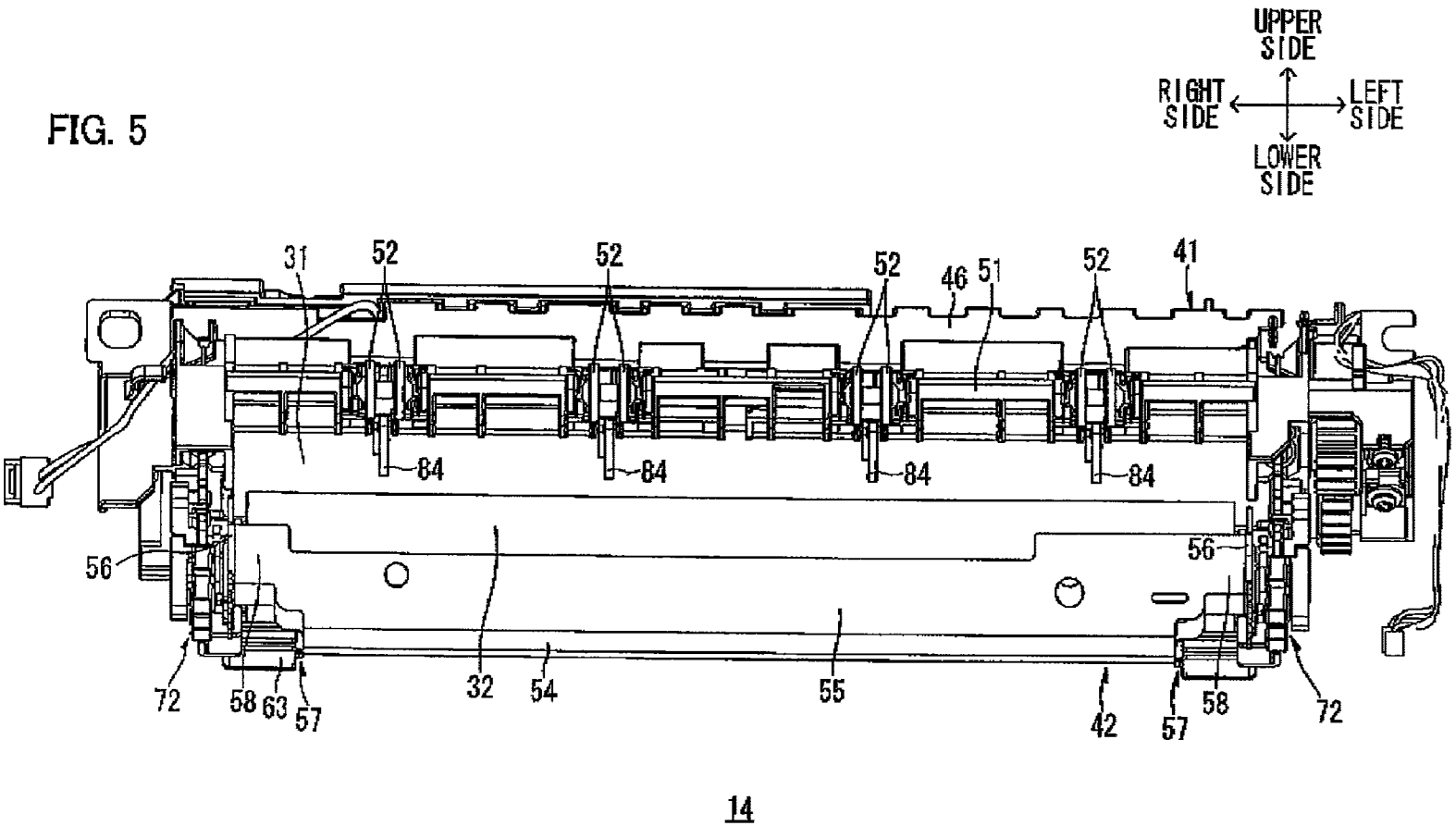
FIG. 5 is a rear elevational view of the fixing unit in the nip state (as viewed from the rear side).
Figure 6:
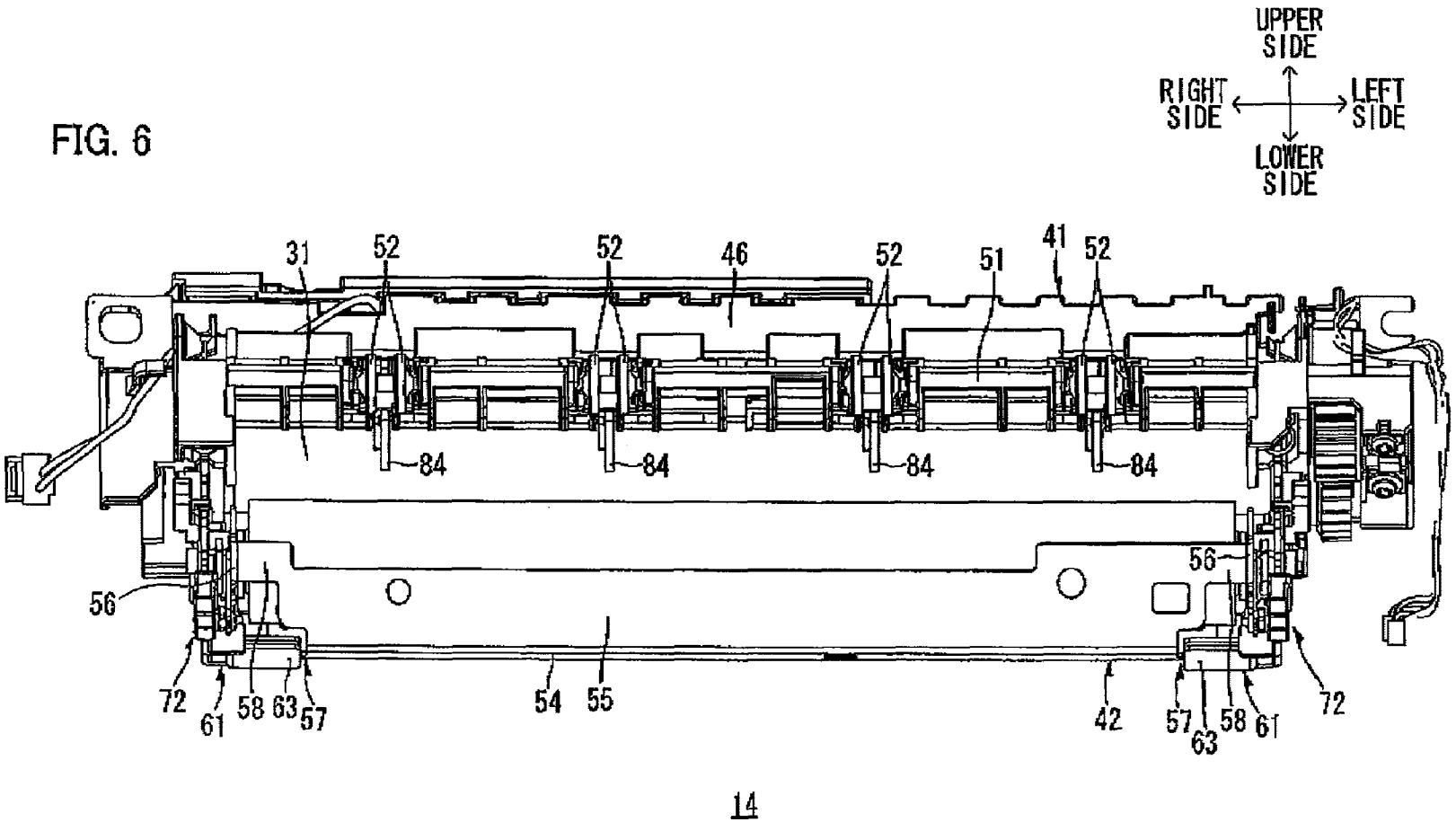
FIG. 6 is a rear elevational view of the fixing unit in the release state.
Figure 7:
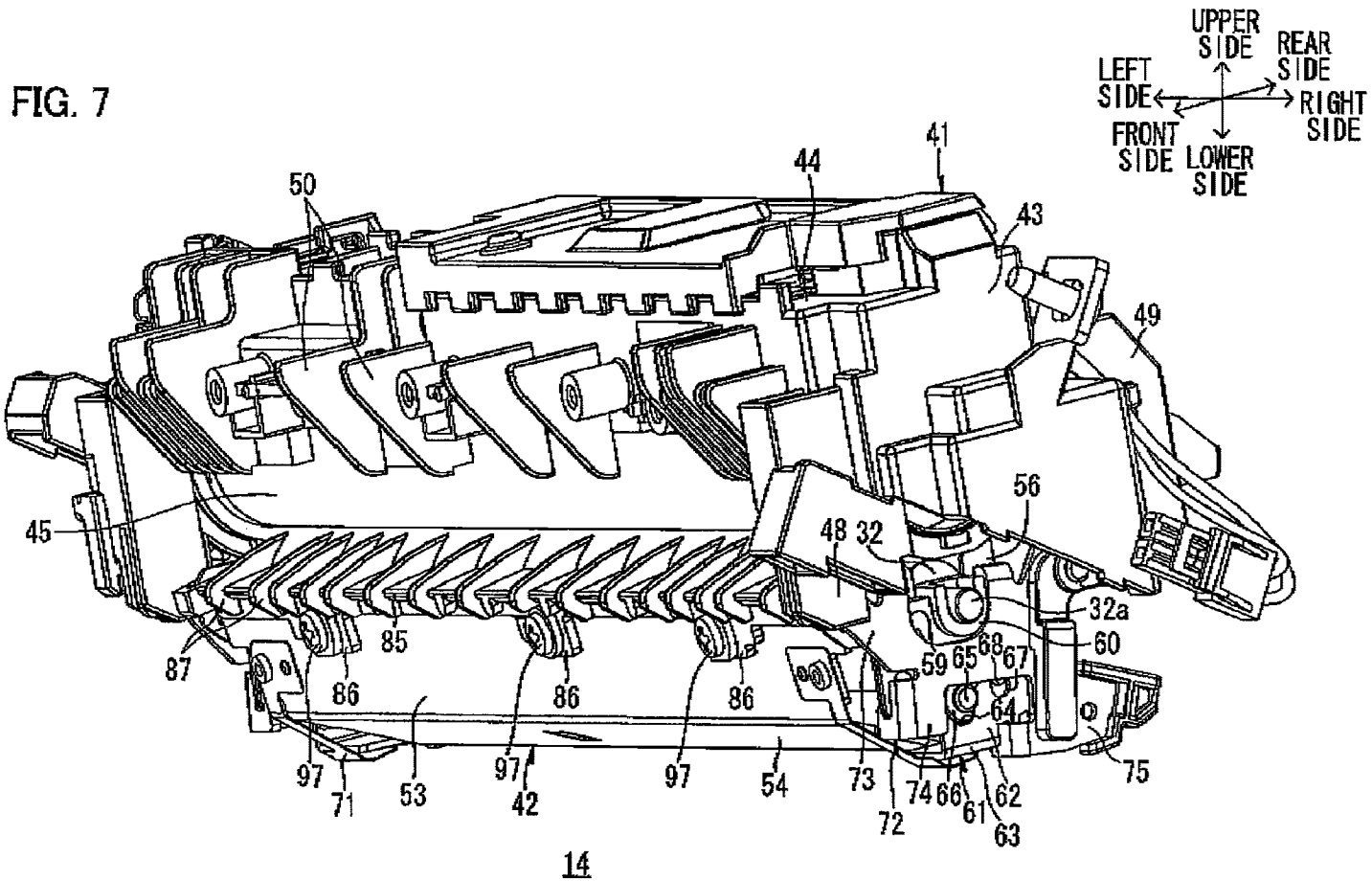
FIG. 7 is a perspective view of the fixing unit as viewed from the front right side.

FIGS. 2(*a*), 2(*b*), 3(*a*), 3(*b*), 4(*a*) and 4(*b*) are partially cut right side elevational views of the fixing unit 14. FIGS. 5 and 6 are rear elevational views of the fixing unit 14 (as viewed from the rear side). FIG. 7 is a perspective view of the fixing unit 14 as viewed from the front right side.

(1) Frame

The fixing unit 14 includes an upper frame 41 as an example of a second holding member rotatably holding the heating roller 31 and a lower frame 42 rotatably holding the pressure roller 32. The upper and lower frames 41 and 42 are not connected with each other, and the lower frame 42 is rendered movable in the circumferential direction of the heating roller 31 with respect to the upper frame 41.

(1-1) Upper Frame

The upper frame 41 is made of resin, and integrally includes a pair of lateral sidewalls 43, an upper wall 44, a front wall 45 and a rear wall 46.

The pair of sidewalls 43 are opposed to each other at an interval in the lateral direction, as shown in FIGS. 5 and 6. Each sidewall 43 is provided with a notched portion 47 receiving an end portion of the heating roller 31, as shown in FIG. 2(*a*), for example.

A pressuring member support portion 48 for supporting a pressuring member 72 (described later) as an example of an urging mechanism is provided on a front portion of each sidewall 43. A square tubular spring receiving portion 49 receiving a coil spring 77 (described later) is provided on the rear end portion of each sidewall 43.

The upper wall 44 is extended between the upper end portions of the sidewalls 43.

The front wall 45 is extended between the front portions of the sidewalls 43. A plurality of sheet guide upper ribs 50 for guiding the sheet P to the space between the heating roller 31 and the pressure roller 32 are provided on the front surface of the front wall 45 at proper intervals in the lateral direction. Each sheet guide upper rib 50 is in the form of a triangular plate protruding frontward so that the protrusion thereof is tapered downward.

The rear wall 46 is extended between the rear end portions of the sidewalls 43. The rear wall 46 is provided with a roller holding portion 51. The roller holding portion 51 protrudes rearward from the almost overall width of the rear wall 46. On the forward end portion of the roller holding potion 51, rollers 52 for guiding transportation of the sheet P after the fixation are rotatably held on a plurality of positions at proper intervals in the lateral direction respectively. On the lower surface of the roller holding portion 51, sheet separation pawls 84 generally triangular in side elevational view are provided on positions corresponding to the rollers 52 respectively, for separating the sheet P from the peripheral surface of the heating roller 31, as shown in FIGS. 5 and 6.

(1-2) Lower Frame

The lower frame 42 is formed by bending a metal plate which is a conductive member, and integrally includes a front wall 53 as an example of a connecting portion, a bottom wall 54, a rear wall 55 and a lateral pair of sidewalls 56 as examples of urged portions, as shown in FIGS. 2(*a*) to 4(*b*).

The front wall 53 is opposed to the pressure roller 32 from the front side, and extends in the lateral direction (orthogonal to the passage direction of the sheet P passing through the space between the heating roller 31 and the pressure roller 32 and the opposed direction of the heating roller 31 and the pressure roller 32, i.e., the axial direction of the pressure roller 32) and the vertical direction.

As shown in FIG. 7, a platelike rib support plate 85 extending in the anteroposterior and lateral directions is provided on the front surface of the front wall 53 along the upper edge of the front wall 53. A plurality of fixing portions 86 are integrally formed on the rib support plate 85, and the rib support plate 85 is mounted on the front wall 53 through screws 97 inserted into the fixing portions 86 respectively. A plurality of sheet guide lower ribs 87 as examples of a guide member for guiding the sheet P to the space between the heating roller 31 and the pressure roller 32 are provided on the rib support plate 85 at intervals in the lateral direction. Each sheet guide lower rib 87 is in the form of a triangular plate extending in the anteroposterior and vertical directions so that the vertical size thereof is increased toward the front wall 53. The sheet P fed to the fixing unit 14 moves in sliding contact with the upper edge of each sheet guide lower rib 87, to be guided to the space between the heating roller 31 and the pressure roller 32.

The bottom wall 54 is generally in the form of a rectangle extending rearward from the lower edge of the front wall 53. As shown in FIGS. 5 and 6, the bottom wall 54 is smaller in lateral width than the front wall 53, and spaces 57 are defined between the right and left edges of the bottom wall 54 and the right and left sidewalls 56.

The rear wall 55 extends upward from the rear edge of the bottom wall 54. A pair of extending portions 58 extending rightward and leftward respectively are formed on the upper end portion of the rear wall 55.

Each sidewall 56 is bent frontward from the forward edge of the corresponding extending portion 58 of the rear wall 55, and extends in the anteroposterior direction. Each side wall 56 is notched downward from the upper edge in a generally U-shaped manner, to form a bearing receiving portion 59, as shown in FIG. 2(*a*), for example. A bearing member 60 made of conductive resin is fitted into and fixed to the bearing receiving portion 59. Thus, the bearing member 60 fitted into the bearing receiving portion 59 is electrically connected with the bearing receiving portion 59. The rotating shaft 32*a* made of a conductive metal of the pressure roller 32 is rotatably inserted into the bearing member 60, so that the pressure roller 32 is rotatably held between the sidewalls 56. Thus, the rotating shaft 32*a* of the pressure roller 32 is rotatably inserted into the bearing member 60, to be electrically connected with the bearing member 60.

According to this embodiment, the bearing member 60 and the lower frame 42 constitutes an example of the first holding member according to the present invention.

(2) Positioning Member

A positioning member 61 formed by bending a metal plate is provided on the outer side of each sidewall 56 (the right side of the right sidewall 56 and the left side of the left sidewall 56) of the lower frame 42, as shown in FIG. 2(*a*), for example. Each positioning member 61 integrally includes a body portion 62 externally opposed to the sidewall 56 in the axial direction of the pressure roller 32 and an operating portion 63 extending from the central portion of the lower edge of the body portion 62 toward the space 57 between the bottom wall 54 and the corresponding sidewall 56 of the lower frame 42.

As shown in FIG. 2(*b*), a slot 64 longitudinal in the opposed direction (generally vertical direction) of the heating roller 31 and the pressure roller 32 is formed in the anteroposterior central portion of the body portion 62. A boss 65 protrusively provided on the corresponding sidewall 56 of the lower frame 42 is inserted into the slot 64 in a free-fit state. A generally C-shaped stopper 66 of resin is fixed to the forward end of the boss 65. On the body portion 62, further, slots 67 longitudinal in the opposed direction of the heating roller 31 and the pressure roller 32 (major axis direction of the slot 64) are formed on positions separated from the front and rear sides of the slot 64 respectively. Another boss 68 protrusively provided on the corresponding sidewall 56 of the lower frame 42 is inserted into each slot 67 in a free-fit state. Thus, the positioning member 61 is rendered undroppable from the corresponding sidewall 56 of the lower frame 42 and movable in the opposed direction of the heating roller 31 and the pressure roller 32.

The lower edge of the body portion 62 is in the form of an arc centering on the rotation axis of the heating roller 31 on both anteroposterior sides of the operating portion 63. A plurality of protrusions 69 protruding downward from the lower edge of the body portion 62 are formed at intervals, whereby positioning portions 70 defined by recesses adjacent to the protrusions 69 are formed on the body portion 62 along the circumferential direction of the heating roller 31 (may hereinafter be simply referred to as "circumferential direction"). The bottom surfaces of the positioning portions 70 are located above the lower end portion 56*a* of the corresponding sidewall 56 of the lower frame 42, so that engaging sections 80 and 81 described later do not come into contact with the lower surfaces.

Each operating portion 63 has a generally rectangular shape. A one end portion of a plate spring 71 is fixed to the surface of each operating portion 63 opposed to the pressure roller 32. The other end portion of the plate spring 71 is fixed to the front wall 53 of the lower frame 42. Thus, the plate spring 71 urges the positioning member 61 downward (oppositely to the urging direction of the coil spring 77 described later). The one end portion of the plate spring 71 may alternatively be simply in contact with the surface of each operating portion 63 opposed to the pressure roller 32.

(3) Pressuring Member

A pressuring member 72 as an example of an arm member formed by bending a metal member which is a conductive member is provided on the outer side of each positioning member 61. Each pressuring member 72 integrally includes a body portion 73 generally V-shaped in side elevational view and two engaging portions 74 and 75.

Figure 3:
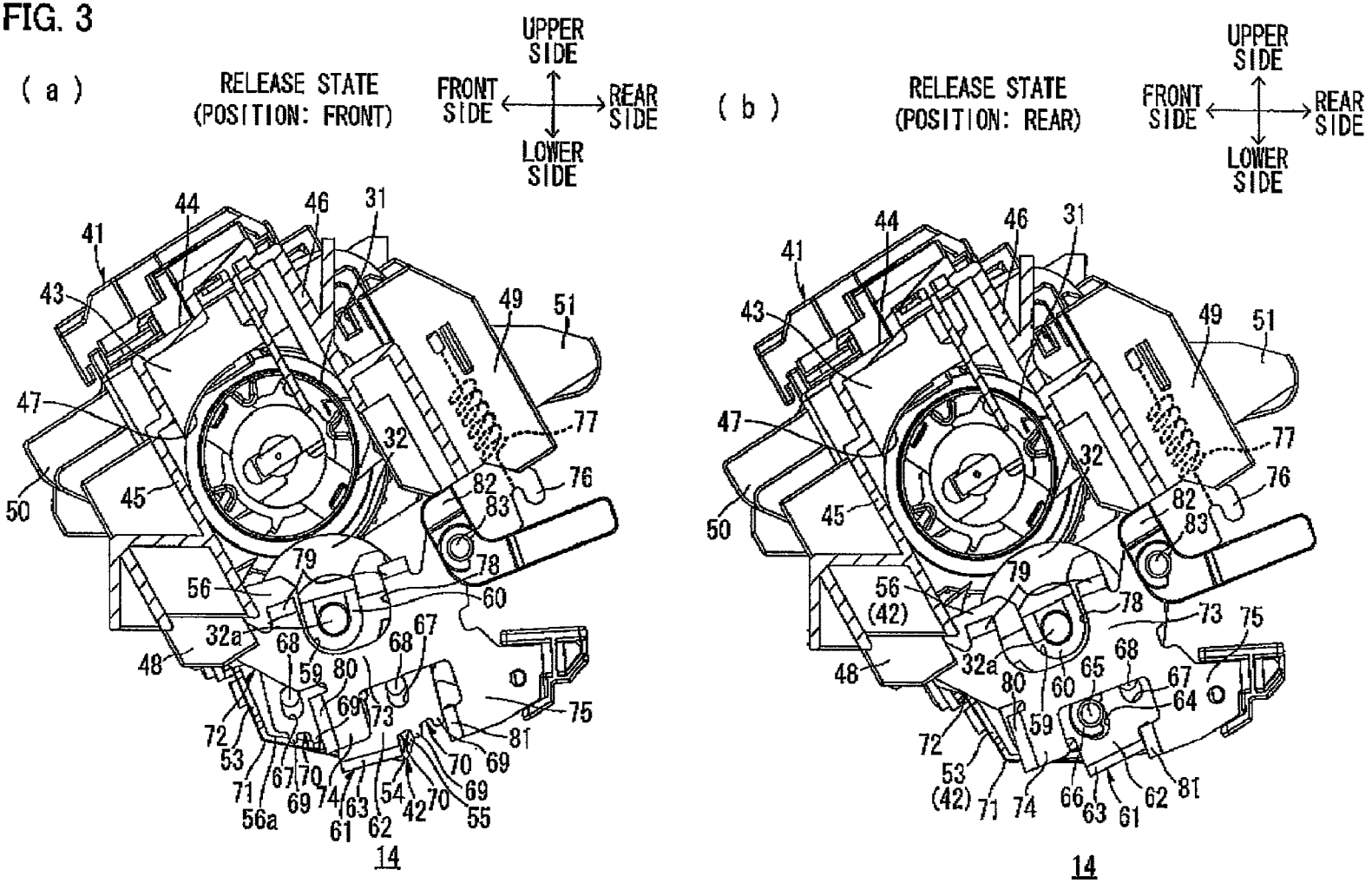
FIGS. 3(*a*) and 3(*b*) are partially cut right side elevational views showing the fixing unit in a release state, with the pressure roller arranged relatively frontward and relatively rearward respectively.

The body portion 73 is externally opposed to the corresponding sidewall 56 of the lower frame 42 in the direction of the rotating shaft of the pressure roller 32. A one end portion of the generally V-shaped body portion 73 enters the pressuring member support portion 48 of the upper frame 41. The pressuring member support portion 48 is provided with a laterally extending support shaft (not shown), and the one end portion of the body portion 73 is rotatably supported by this support shaft. On the other hand, a hook portion 76 is formed on the other end portion of the generally V-shaped body portion 73, as shown in FIG. 3(*a*), for example. A one end 77*b* of the coil spring 77 made of a conductive tension spring received in the spring receiving portion 49 of the upper frame 41 is engaged on the hook portion 76. Thus, the one end 77*b* of the coil spring 77 is so engaged on the hook portion 76 that the pressuring member 72 and the coil spring 77 are electrically connected with each other. The other end 77*a* of the coil spring 77 as an example of a spring member constituting an urging mechanism along with the pressuring member 72 is engaged on an engage portion 49*a* of the spring receiving portion 49, and the coil spring 77 has elastic force in a direction for approximating both ends thereof to each other, i.e., a direction for approximating the hook portion 76 to the upper frame 41. The mechanism constituted of the pressuring member 72 and the coil spring 77 is an example of the urging mechanism according to the present invention.

A notch 78 generally U-shaped in side elevational view is formed between the one end and the other end portions of the body portion 73. The bearing member 60 enters the notch 78, thereby regulating the quantity of movement of the lower frame 42 in the circumferential direction.

Pawl portions 79 extending toward the sidewall 56 of the lower frame 42 are formed on both anteroposterior sides of the notch 78. Each pawl portion 79 is opposed to the bearing member 60 from above. Thus, the lower frame 42 is undroppably provided between four pawl portions 79 and the engaging portions 74 and 75 described below, with clearances.

The engaging portion 74 extends downward from the front side portion of the lower end portion of the body portion 73, and is bent in a generally L-shaped manner in bottom plan view, to be opposed to the operating portion 63 of the positioning member 61 from the front side. The forward end portion 80 (opposed to the operating portion 63) of the engaging portion 74 is rectangularly notched from the upper end thereof, to be opposed to the lower edge of the body portion 62 of the positioning member 61 from below. The forward end portion 80 defines the engaging section entering one of the positioning portions 70 of the positioning member 61 and engaging with this positioning portion (recess) 70 in a state where no force other than the urging force of the plate spring 71 is applied to the positioning member 61.

The engaging portion 75 extends downward from the rear side portion of the lower end portion of the body portion 73. The engaging portion 75 includes the engaging section 81 extending toward the positioning member 61 from the front edge of the lower end portion thereof. The engaging section 81 is opposed to the lower edge of the body portion 62 of the positioning member 61 from below, and enters another one of the positioning portions 70 of the positioning member 61 in the state where no force other than the urging force of the plate spring 71 is applied to the positioning member 61.

In each pressuring member 72, the other end portion of the body portion 73 is urged by the elastic force of the coil spring 77 in the approximating direction of the coil spring 77 about the one end portion of the body portion 73. Thus, the engaging sections 80 and 81 of each pressuring member 72 come into contact with the lower end portion 56*a* of the corresponding sidewall 56 of the lower frame 42, to press the lower frame 42 in a direction for approaching the upper frame 41. Thus, the pressure roller 32 held by the lower frame 42 comes into contact with the heating roller 31 held by the upper frame 41 in a pressing state, to enter the so-called nip state. The engaging sections 80 and 81 of each pressuring member 72 come into contact with the lower end portion 56*a* of the corresponding sidewall 56 of the lower frame 42 in this manner, whereby each pressuring member 72 and the lower frame 42 are electrically connected with each other.

(4) Releasing Member

A releasing member 82 for releasing the pressure roller 32 from the state pressing the heating roller 31 is mounted on each pressuring member 72. The releasing member 82 is made of resin, and generally L-shaped in side elevational view. A support shaft 83 extending outward from the pressuring member 72 is inserted into a bent portion of the releasing member 82. The releasing member 82 is supported by the support shaft 83, to be swingable between a first state (see FIGS. 2(*a*) and 2(*b*)) where the longer portion thereof extends downward and the shorter portion is opposed to the corresponding sidewall 43 of the upper frame 41 at an interval and a second state (see FIGS. 3(*a*), 3(*b*), 4(*a*) and 4(*b*)) where the longer portion extends rearward and the forward end of the shorter portion comes into contact with the corresponding sidewall 43 of the upper frame 41.

(5) Operation of Changing Contact Position of Pressure Roller 32 With Respect to Heating Roller 31

Each releasing member 82 is not in contact with the corresponding sidewall 43 of the upper frame 41 when the same is in the first state as shown in FIG. 2(*a*), and hence only the elastic force of the coil spring 77 acts on each pressuring member 72. Therefore, each pressuring member 72 presses the lower frame 42, and the pressure roller 32 comes into contact with the heating roller 31 in the pressing state.

When displaced from the first state to the second state as shown in FIG. 3(*a*), each releasing member 82 comes into contact with the corresponding sidewall 43 of the upper frame 41 and presses the upper frame 41, whereby the upper frame 41 and each pressing member 72 separate from each other against the elastic force of the coil spring 77. Consequently, the pressure roller 32 slightly moves in the direction for separating from the heating roller 31 and is released from the state pressing the heating roller 31, to enter a release state separating from the heating roller 31 or softly in contact therewith.

Figure 4:
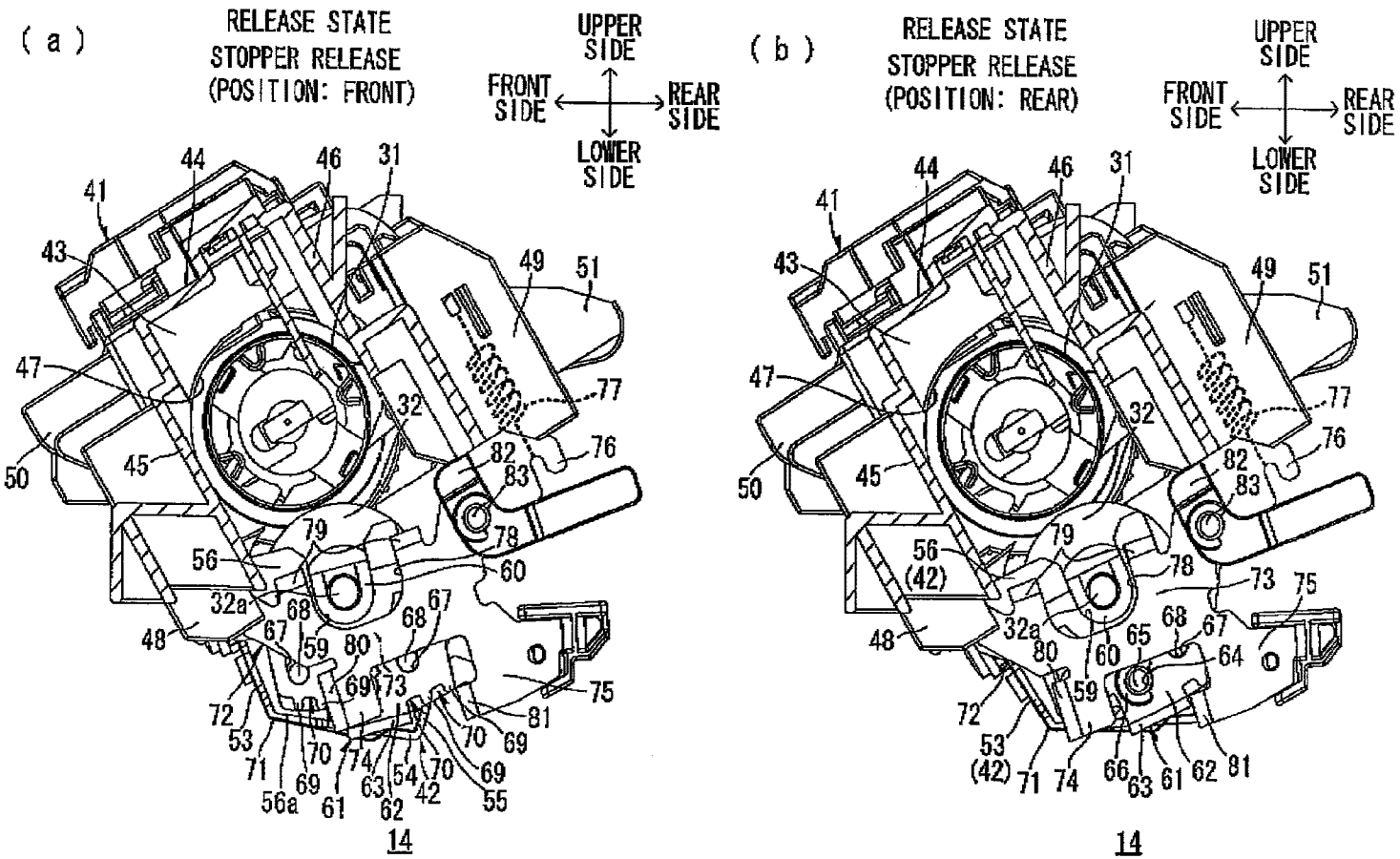
FIGS. 4(*a*) and 4(*b*) are partially cut right side elevational views of the fixing unit stopper-released in the release state, with the pressure roller arranged relatively frontward and relatively rearward respectively.

When the operating portion 63 of each positioning member 61 is pressed (toward the pressure roller 32) against the urging force of the plate spring 71, each positioning member 61 moves upward, and the engaging sections 80 and 81 of each pressuring member 72 separate from the positioning portions 70, as shown in FIG. 4(*a*). Thus, the lower frame 42 is released from a positioned state resulting from the engagement between the engaging sections 80 and 81 and the positioning portions 70 (stopper release), and can be moved in the circumferential direction of the heating roller 31 with respect to the upper frame 41.

Due to this movement of the lower frame 42 with respect to the upper frame 41, the pressure roller 32 can be moved in the circumferential direction of the heating roller 31 in the release state. As shown in FIG. 4(*b*), for example, the pressure roller 32 can be moved rearward along the circumferential direction with respect to the heating roller 31 from the state shown in FIG. 4(*a*).

When each releasing member 82 is displaced from the second state to the first state from the release state shown in FIG. 4(*b*), the pressure roller 32 is pressed against the heating roller 31 and comes into contact therewith, as shown in FIG. 2(*b*). Referring to FIG. 4(*b*), the pressure roller 32 is in contact with the heating roller 31 on a side rearward beyond the state shown in FIG. 4(*a*) along the circumferential direction.

The pressure roller 32 can be also moved frontward along the circumferential direction with respect to the heating roller 31, similarly to the above.

(6) Grounding Structure

Figure 8:
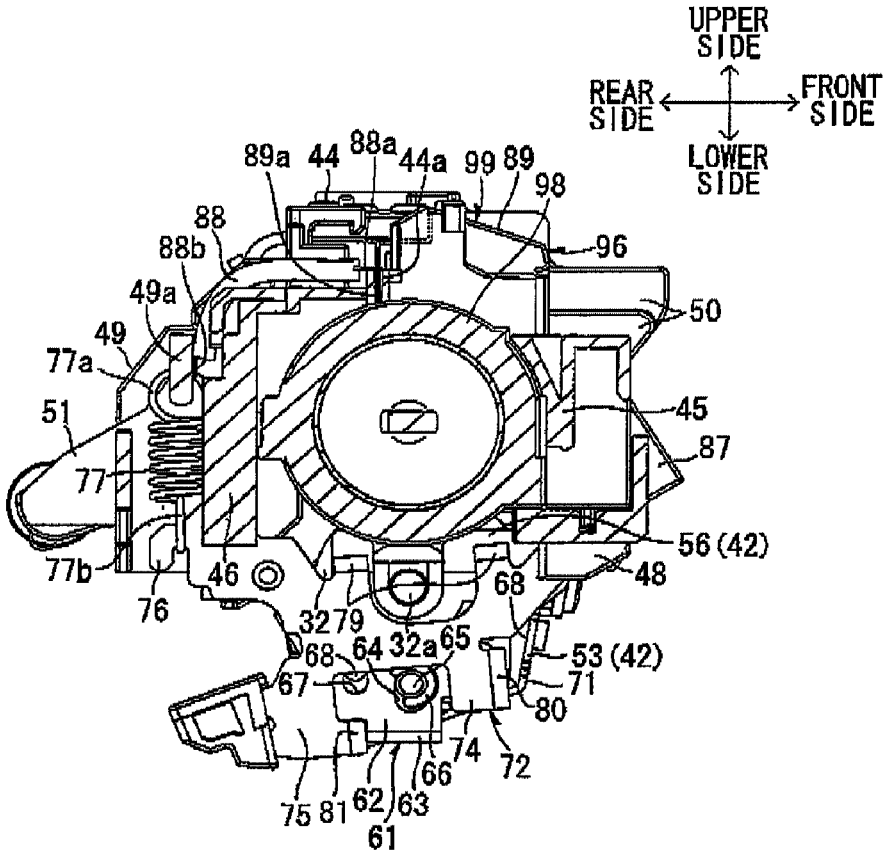
FIG. 8 is a partially cut left side elevational view of the fixing unit.
Figure 9:
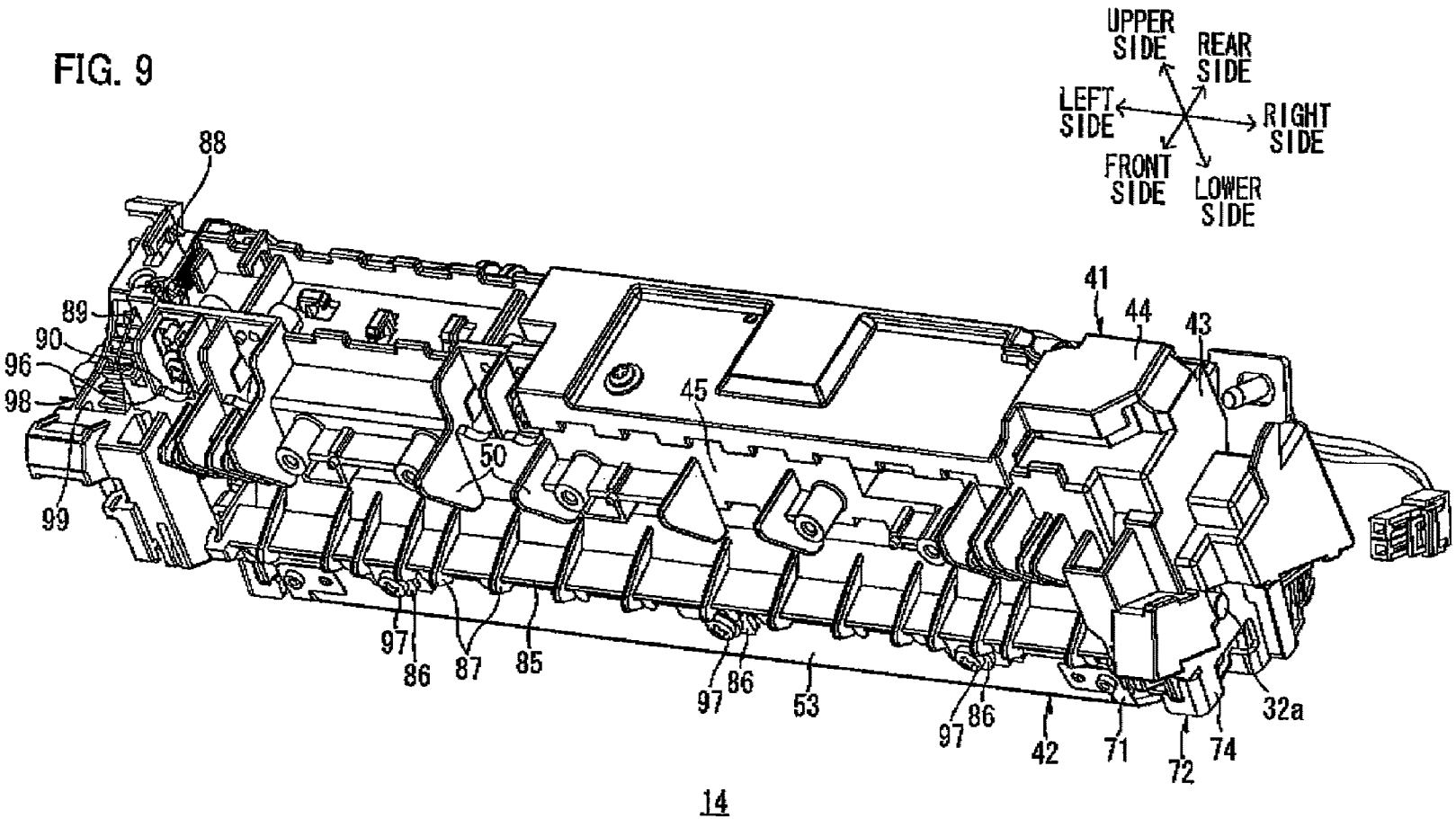
FIG. 9 is a perspective view of the fixing unit as viewed from the front upper right side.
Figure 10:
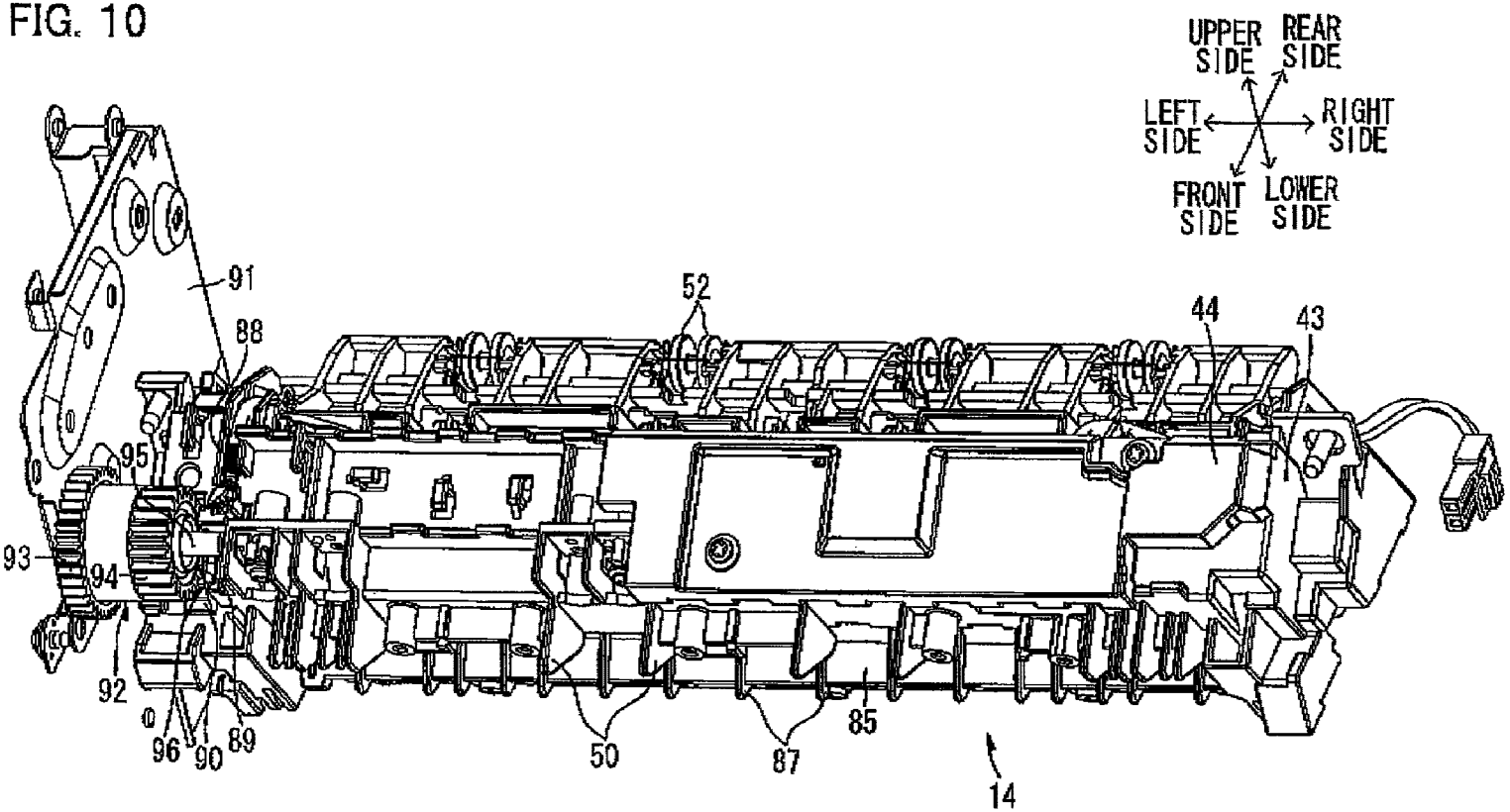
FIG. 10 is a perspective view showing the fixing unit mounted on a main body casing, as viewed from the front upper right side.

FIG. 8 is a partially cut left side elevational view of the fixing unit 14. FIG. 9 is a perspective view of the fixing unit 14 as viewed from the front upper right side. FIG. 10 is a perspective view of the fixing unit 14 mounted on the main body casing 2, as viewed from the front upper right side.

As shown in FIG. 8, two heating roller bearing members 98 made of conductive resin as examples of a second connecting member are provided between the front wall 45 and the rear wall 46 of the upper frame 41 at an interval in the lateral direction, in a state held between the front wall 45 and the rear wall 46. Axial end portions of the heating roller 31 are inserted into the two heating roller bearing members 98 respectively, so that the heating roller 31 is rotatably held in the upper frame 41.

A ground contact member 89 formed by bending a metal wire which is a conductive member is mounted on the left end portion of the upper wall 44 of the upper frame 41, as shown in FIG. 8. The ground contact member 89 is provided through a penetration hole 44*a* of the upper wall 44, so that a one end portion 89*a* arranged in the upper frame 41 is electrically connected to the corresponding heating roller bearing member 98. On the other hand, the other end portion of the ground contact member 89 arranged outside the upper frame 41 is bent in the form of a hook in side elevational view, to define a contact 96 exposed frontward and upward from the upper frame 41.

A one end 88*a* of a connecting coil spring 88 as an example of a first connecting member is electrically connected to an intermediate portion of the ground contact member 89. The connecting coil spring 88 which is a conductive member is so arranged as to extend from the upper wall 44 to the rear wall 46 of the upper frame 41. The other end 88*b* of the connecting coil spring 88 is electrically connected to the end 77*a* of the coil spring 77 engaged on the spring receiving portion 49.

In the upper frame 41, a fixing gear 90 coaxial with the heating roller 31 is provided on the left end portion, as shown in FIG. 9. On the upper wall 44 of the upper frame 41, a notched portion 99 is formed by partially notching the upper frame 41 on the left side of the ground contact member 89 in plan view, and the circumferential surface of the fixing gear 90 is partially exposed from the notched portion 99.

As shown in FIG. 10, a side plate 91 of a metal opposed to the fixing unit 14 from the left side is provided in the main body casing 2. The side plate 91 is provided with a gear shaft 95 of a (conductive) metal protruding toward the fixing unit 14, and the forward end portion of the gear shaft 95 is in contact with the contact 96 from the front side. Thus, the lower frame 42 is grounded through the pressuring member 72, the coil spring 77, the connecting coil spring 88, the ground contact member 89 (contact 96), the gear shaft 95 and the side plate 91. Further, the pressure roller 32 is grounded through the rotating shaft 32*a* and the bearing member 60 (lower frame 42).

The heating roller bearing member 98 is grounded through the ground contact member 89 (contact 96), the gear shaft 95 and the side plate 91.

A driving gear 92 is rotatably supported on the gear shaft 95. An input gear portion 93 receiving driving force from an unshown motor is formed on the left end portion of the driving gear 92. An output gear portion 94 meshing with the fixing gear 90 is formed on the right end portion of the driving gear 92.

Thus, the driving gear 92 rotates when the driving force from the motor is input in the input gear portion 93. When the driving gear 92 rotates, the driving force is transmitted to the fixing gear 90 through the output gear portion 94, so that the fixing gear 90 rotates.

In order to assemble this image forming apparatus, the fixing unit 14 is mounted frontward from the rear side of the main body casing 2. In other words, the fixing unit 14 is mounted on the main body casing 2 from the same direction as the contact 96 coming into contact with the gear shaft 95. Thus, the contact 96 can reliably come into contact with the gear shaft 95 when the fixing unit 14 is mounted on the main body casing 2.

3. Effects

As hereinabove described, the pressure roller 32 opposed to the heating roller 31 is held by the lower frame 42. The pressure roller 32 is position-changeably supported by the pressuring member 72 and the coil spring 77 through the lower frame 42, and urged toward the heating roller 31 through the lower frame 42.

The pressuring member 72 is in contact with the lower frame 42 for urging the pressure roller 32, regardless of the position of the pressure roller 32. Therefore, the pressuring member 72 is so grounded and electrically connected with the lower frame 42 that the lower frame 42 can be grounded regardless of the position of the pressure roller 32.

The pressure roller 32 has the rotating shaft 32*a* made of a conductive material. The lower frame 42 is also made of a conductive material, and the rotating shaft 32*a* is held by the bearing member 60 made of a conductive material. Therefore, the lower frame 42 and the pressure roller 32 are electrically connected with each other. Thus, the pressure roller 32 can be grounded by grounding the lower frame 42. Consequently, the pressure roller 32 can be reliably grounded regardless of the position thereof, also in the position-changeably provided structure.

The pressuring member 72 includes the coil spring 77. The one end of the coil spring 77 is engaged on the upper frame 41 holding the heating roller 31, to be arranged on a constant position. Therefore, destabilization of the grounded state of the coil spring 77 can be prevented by connecting the connecting coil spring 88 to the one end of the coil spring 77. On the other hand, the other end of the coil spring 77 is a free end, which in turn is so connected to the pressuring member 72 urging the lower frame 42 that the connection between the coil spring 77 and the lower frame 42 can be ensured regardless of the position of the pressure roller 32. Consequently, a stable grounded state of the lower frame 42 can be ensured through the coil spring 77, regardless of the position of the pressure roller 32.

In the direction orthogonal to the passage direction of the sheet P passing through the space between the heating roller 31 and the pressure roller 32 and the opposed direction of the heating roller 31 and the pressure roller 32, i.e., in the axial direction of the pressure roller 32, the pair of sidewalls 56 urged by the pressuring member 72 are provided on both ends of the pressure roller 32. The pair of sidewalls 56 are connected with each other by the front wall 53 extending in the axial direction of the pressure roller 32. While such a longitudinal front wall 53 easily stores charges, the lower frame 42 formed by the pair of sidewalls 56 and the front wall 53 is grounded through the pressuring member 72, whereby the front wall 53 can be prevented from storing charges.

The front wall 53 is provided with the sheet guide lower ribs 87 guiding the sheet P. The front wall 53 extends in the width direction of the sheet P, whereby the sheet guide lower ribs 87 can be provided over a wide range in the width direction. Therefore, the sheet guide lower ribs 87 can excellently guide the sheet P. When the position of the pressure roller 32 with respect to the heating roller 31 is changed, the positions of the sheet guide lower ribs 87 are also changed, thereby excellently guiding the sheet P regardless of the position of the pressure roller 32. Consequently, the sheet P can be excellently transported while preventing the front wall 53 from storing charges.

The connecting coil spring 88 electrically connects the ground contact member 89 with the coil spring 77 and the pressuring member 72. Further, the heating roller bearing members 98 electrically connect the ground contact member 89 and the heating roller 31 with each other. Thus, the pressuring member 72 can be grounded through the connecting coil spring 88 and the ground contact member 89. Further, the heating roller 31 can be grounded through the heating roller bearing members 98 and the ground contact member 89. Consequently, both of the pressure roller 32 and the heating roller 31 can be grounded by grounding the single ground contact member 89.

The gear shaft 95 rotatably supporting the driving gear 92 is made of a conductive material, and the pressuring member 72 provided on the fixing unit 14 is grounded through this gear shaft 95. Thus, the pressuring member 72 can be grounded without newly adding another member for grounding the pressuring member 72. The pressuring member 72 is so grounded that the pressure roller 32 can be reliably grounded regardless of the position thereof. Consequently, discharge from the pressure roller 32 can be prevented, and reduction of image quality resulting from discharge can be prevented.

Second Embodiment

While the aforementioned embodiment is applied to a monochromatic laser printer as an example of the image forming apparatus, the image forming apparatus according to the present invention can also be constituted as a color laser printer (including a tandem type or an intermediate transfer type).

While the heating roller 31 is employed as an example of the heating member, the heating member may alternatively be formed by a film employed in a film fixing system, or may alternatively be prepared by applying a film to a heating roller.

The pressure member is not restricted to the pressure roller 32, but may be prepared by stretching a belt over a roller.

The pressuring member support portion 48 is provided with the support shaft (swing shaft) supporting the pressuring member 72 as an example of the support mechanism, and hence this support shaft may be so grounded as to ground the pressure roller 32 through the pressuring member 72 and the lower frame 42.

The lower frame 42maybe so omitted that the pressuring member 72 supports the bearing member 60 in a position-changeable and urged state.

If the lower frame 42 is grounded, the pressure roller 32 may not necessarily be grounded. In this case, a nonconductive material may be employed as the material for the rotating shaft 32*a* of the pressure roller 32 and/or the bearing member 60.

While the pressure roller 32 is supported by the pressuring member 72 through the lower frame 42, a support mechanism supporting the lower frame 42, the bearing member 60 or the rotating shaft 32*a* of the pressure roller 32 without urging the same may be provided.

While the position of the pressure roller 32 is manually changed, the position of the pressure roller 32 may alternatively be changed by driving force of a motor or the like.

The embodiments described above are illustrative and explanatory of the invention. The foregoing disclosure is not intended to be precisely followed to limit the present invention. In light of the foregoing description, various modifications and alterations may be made by embodying the inventions. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A fixing apparatus comprising:
a heating member;
a pressure member opposed to the heating member;
a first holding member holding the pressure member;
a second holding member holding the heating member; and
an urging mechanism movably supporting the pressure member through the first holding member and urging the pressure member toward the heating member through the first holding member,
wherein the first holding member is electrically connected with the urging mechanism,
wherein the first holding member and the urging mechanism are both formed of a conductive member,
wherein the first holding member is grounded through the urging mechanism,
wherein the urging mechanism includes a spring member having a one end engaged on the second holding member,
wherein the spring member has conductivity, and
wherein the pressure member is grounded through the spring member.

2. The fixing apparatus according to claim 1,
wherein the heating member rotates, and
wherein the urging mechanism positionably supports the pressure member with respect to the heating member on a plurality of positions along a rotational direction of the heating member.

3. The fixing apparatus according to claim 1, wherein the pressure member is grounded through the first holding member and the urging mechanism.

4. The fixing apparatus according to claim 1, wherein the spring member is grounded from a side of the one end of the spring member engaged on the second holding member.

5. The fixing apparatus according to claim 4, wherein the spring member is a tension spring.

6. The fixing apparatus according to claim 5,
wherein the urging mechanism has an arm member for supporting the first holding member,
wherein the other end of the spring member is engaged on the arm member, and
wherein the spring member is configured to urge the pressure member toward the heating member through the arm member and the first holding member.

7. The fixing apparatus according to claim 1,
wherein the heating member is a heating roller,
wherein the pressure member is a pressure roller having a shaft of a metal, and
wherein the pressure roller is grounded from the shaft.

8. The fixing apparatus according to claim 1,
wherein the first holding member includes:
a pair of urged portions provided on both ends of the pressure member in a direction orthogonal to a passage direction of a recording sheet passing through the space between the heating member and the pressure member and the opposed direction of the heating member and the pressure member and urged by the urging mechanism; and
a connecting portion connecting the pair of urged portions with each other.

9. The fixing apparatus according to claim 8, further comprising a guide member provided on the connecting portion for guiding the recording sheet.

10. The fixing apparatus according to claim 1,
wherein the pressure member is a pressure roller having a pressure roller shaft made of a conductive material,
wherein the first holding member includes a bearing member made of a conductive material for rotatably holding the pressure roller shaft, and
wherein the pressure roller is electrically connected with the urging mechanism through the bearing member and the pressure roller shaft.

11. The fixing apparatus according to claim 1, further comprising:
a contact;
a first connecting member electrically connecting the contact and the urging mechanism with each other; and
a second connecting member electrically connecting the contact and the heating member with each other.

12. A fixing apparatus comprising:
a heating member;
a pressure member opposed to the heating member;
a first holding member holding the pressure member;
a second holding member holding the heating member; and
a support mechanism movably supporting the pressure member through the first holding member,
wherein the first holding member is electrically connected with the support mechanism,
wherein the support mechanism and the first holding member are formed of a conductive member,
wherein the pressure member is grounded through the first holding member and the support mechanism,
wherein the urging mechanism includes a spring member having a one end engaged on the second holding member,
wherein the spring member has conductivity, and
wherein the pressure member is grounded through the spring member.

13. The fixing apparatus according to claim 12,
wherein the heating member rotates, and
wherein the support mechanism positionably supports the pressure member with respect to the heating member on a plurality of positions along a rotational direction of the heating member.

14. An image forming apparatus comprising:
a fixing apparatus;
a gear shaft made of a conductive material; and
a driving gear rotatably supported on the gear shaft for transmitting driving force to the fixing apparatus,
wherein the fixing apparatus includes:
a heating member;
a pressure member opposed to the heating member;
a first holding member holding the pressure member;
a second holding member holding the heating member; and an urging mechanism movably supporting the pressure member through the first holding member and urging the pressure member toward the heating member through the first holding member, wherein the first holding member is electrically connected with the urging mechanism, wherein the urging mechanism is grounded through the gear shaft, wherein the urging mechanism includes a spring member having a one end engaged on the second holding member, wherein the spring member has conductivity, and wherein the pressure member is grounded through the spring member.

* * * * *